US005204012A

United States Patent [19]

Schaffhausen

[11] Patent Number: 5,204,012

[45] Date of Patent: Apr. 20, 1993

[54] SUPPLEMENTAL RUST INHIBITORS AND RUST INHIBITION IN INTERNAL COMBUSTION ENGINES

[75] Inventor: John G. Schaffhausen, Naperville, Ill.

[73] Assignee: Ethyl Corporation, Richmond, Va.

[21] Appl. No.: 304,765

[22] Filed: Jan. 31, 1989

[51] Int. Cl.[5] ..... C10M 129/70

[52] U.S. Cl. ..... 252/52 A; 252/56 R; 252/32.7 E; 252/51.5 R; 252/57; 252/396; 252/407

[58] Field of Search ..... 252/56 R, 52 A, 396, 252/407, 32.7 E, 51.5 R, 57, 396, 407; 560/183, 186

[56] References Cited

U.S. PATENT DOCUMENTS

| | | | |
|---|---|---|---|
| 2,929,696 | 3/1960 | Barusch et al. | 252/396 |
| 3,017,354 | 1/1962 | Riggs, Jr. | 252/396 |
| 3,235,502 | 2/1966 | Waldmann | 252/40.5 |
| 3,424,681 | 1/1969 | Stanford | 252/396 |
| 3,637,501 | 1/1972 | Malec et al. | 252/57 |
| 4,396,492 | 8/1983 | Bardasz | 252/396 |
| 4,493,776 | 1/1985 | Rhodes | 252/52 A |
| 4,664,821 | 5/1987 | Arndt | 252/56 R |
| 4,702,850 | 10/1987 | Gutierrez et al. | 252/396 |

*Primary Examiner*—Margaret Medley

[57] ABSTRACT

An esterification product obtained by reacting ethylene oxide/propylene oxide block copolymer with a long-chain monocarboxylic acid, when employed as a supplemental rust inhibitor in lubricating oils for internal combustion engines, has been found to furnish excellent rust inhibition in the engines and to be compatible with other components in the lubricating oils.

A lubricating oil composition containing such product may be used to inhibit rust formation in an internal combustion engine.

18 Claims, No Drawings

SUPPLEMENTAL RUST INHIBITORS AND RUST INHIBITION IN INTERNAL COMBUSTION ENGINES

BACKGROUND OF THE INVENTION

1. Field of the Invention

This invention relates to lubricating oil compositions and their use to minimize rust formation in internal combustion engines. More particularly, this invention relates to lubricating oil compositions which contain a supplemental rust inhibitor that is compatible with other components of such compositions and which are used in the crankcases of internal combustion engines to inhibit rust formation therein. In addition, this invention relates to a method for operating an internal combustion engine to inhibit rust formation, wherein a lubricating oil composition of the invention is employed in the crankcase of such engine.

2. Description of the Prior Art

A lubricating oil composition for an internal combustion engine contains various components in addition to a hydrocarbon oil of lubricating viscosity. Such other components furnish properties that are not present in the oil of lubricating viscosity but are needed to enable the composition to function properly and effectively in the crankcase of the internal combustion engine. One such component is that material which impedes or inhibits engine rust formation. An example is an overbased detergent, such as an overbased metal sulfonate or overbased metal phenate. The overbased detergent neutralizes the acidic components that are formed during fuel combustion. If a particular lubricating oil composition does not furnish sufficient protection against rust, additional overbased detergent can be added to the formulation. However, such tactics are limited by cost and performance restraints.

It is known that certain materials impede rust formation and should be capable of being used as supplemental rust inhibitors (SRI). Among these are ethylene oxide/propylene oxide block copolymers. However, these materials have the disadvantage of not being compatible with other typical additives in lubricating oil compositions. Consequently, their use as rust inhibitors in internal combustion engine lubricating oils is not practical.

These block copolymers, their derivatives, and related compounds, have been used to produce useful products. Such useful products are described in the art.

In U.S. Pat. No. 3,206,486, Nankee taught the preparation of long-chain unsaturated fatty acid monoesters of polyoxypropylene-polyoxyethylene block copolymer glycols and their use in brake fluids and similar hydraulic fluids and lubricants. He further taught that such brake fluids provide lubricity, non-corrosiveness, and compatibility with other commercial brake fluids.

In U.S. Pat. No. 4,493,776, Rhodes disclosed a supplemental rust inhibitor (SRI) additive comprising a combination of (A) $R_1O[C_2H_4O]_xH$ and/or $R_2O[C_3H_6O]_yH$ with (B) $R_3O[C_2H_4)]_x[C_3H_6O]_yH$ and/or $R_4O[C_3H_6)]_y[C_2H_4O]_xH$, wherein $R_1$, $R_2$, $R_3$, and $R_4$ are hydrocarbyl radicals selected from alkyl, aryl, alkaryl, and arylalkyl groups or combinations thereof having from about 10 to about 24 carbon atoms and wherein x and y may vary independently in the range from 3 to about 15. He further taught that any lubricating oil composition having such SRI also should contain at least one overbased detergent additive as the primary rust inhibitor and at least one ashless dispersant.

In U.S. Pat. No. 3,235,502, Waldmann disclosed the product of the reaction of a fatty acid, such as oleic acid, with either ethylene oxide or propylene oxide, or mixtures thereof, in the presence of a basic catalyst, such as an alkali metal hydroxide, and its use as a foam inhibitor in oil compositions.

In U.S. Pat. No. 4,169,062, Weipert taught the product of a condensation reaction of an aliphatic fatty acid having from about 8 to about 22 carbon atoms in the chain with a mixture of ethylene oxide and propylene oxide in the presence of an alkali catalyst and the use of such a product as a synthetic fiber lubricant.

In U.S. Pat. No. 3,504,041, Weipert disclosed nonionic condensation products prepared by the condensation of an essentially linear primary aliphatic alcohol having from 10 to 18 carbon atoms in the aliphatic chain or a mixture of such alcohols with certain critical amounts of a mixture of ethylene oxide and propylene oxide and their use as surface active agents and as rinse additives in automatic dishwashing machines.

In U.S. Pat. No. 3,577,559, Horsley taught the product of a carboxylic group or phenolic group, a vicinal alkene oxide, such as ethylene oxide, propylene oxide, 1-butene oxide and 2-butene oxide, and a polymethylene cyclic ether, such as trimethylene oxide or tetrahydrofuran, to give a glycol ester or glycol ether containing the polymethylene cyclic ether moiety and the use of such product as a solvent, lubricant, hydraulic fluid, or chemical intermediate.

In U.S. Pat. No. 3,507,790, Beerbower, et al., disclosed oil-in-water emulsions suitable for use in glass molding and metal working operations, which emulsions contained the reaction product of ethylene oxide or propylene oxide with a compound selected from the group consisting of a partial ester of sorbitol, a fatty alcohol, a fatty acid, an aliphatic amine, an alkyl phenol, and mixtures thereof.

Now it has been found that a product prepared by reacting an ethylene oxide/propylene oxide block copolymer with a long-chain monocarboxylic acid and having a total acid number (TAN) that is in the range of about 10 to about 40 is a good SRI, which product is soluble and compatible with other components of a lubricating oil composition.

SUMMARY OF THE INVENTION

There is provided a crankcase lubricating oil composition for internal combustion engines, which composition furnishes excellent rust and corrosion inhibition in internal combustion engines. This composition comprises a major amount of a hydrocarbon oil of lubricating viscosity, a minor amount of a dispersant, a minor amount of a primary rust inhibitor, and a minor amount of an esterification product having a total acid number (TAN) that is in the range of about 10 to about 40 and being prepared by reacting in the presence of a catalyst and at a temperature in the range of about 25° C. (77° F.) to about 111° C. (232° F.) ethylene oxide/propylene oxide block copolymer with a long-chain monocarboxylic acid having an alkyl radical with sufficient carbon atoms to provide solubility of said product in said composition.

The esterification product is present in said composition in an amount that is in the range of about 0.03 wt% to about 1 wt%, based on the weight of said composition.

There is also provided a method for operating an internal combustion engine to inhibit rust formation, which method comprises employing the aforesaid lubricating oil composition in the crankcase of said internal combustion engine.

DETAILED DESCRIPTION AND PREFERRED EMBODIMENTS

Although ethylene oxide/propylene oxide block copolymers have the potential to impede rust formation in internal combustion engines when used as components in the crankcase lubricating oils of such engines, their use to control rust formation is impractical. They are not compatible with other additives that are typically used in crankcase lubricating oil compositions. Those compositions containing such ethylene oxide/propylene oxide block copolymers exhibit a hazy appearance. In some cases, a gel is formed as a result of the incompatibility.

It has now been found that certain esterified ethylene oxide/propylene oxide block copolymers are compatible with other typical additives that are employed in crankcase lubricating oil compositions and that anti-rust activity provided by the copolymers is not diminished by the esterification.

In accordance with the present invention, there is provided a lubricating oil composition containing a supplemental rust inhibitor and a method for operating an internal combustion engine to inhibit rust formation in the crankcase of the internal combustion engine, which method comprises utilizing the aforesaid lubricating oil composition in the crankcase of the internal combustion engine.

The lubricating oil composition of the present invention is a lubricating oil composition comprising a major amount of a hydrocarbon oil of lubricating viscosity, a minor amount of a dispersant, a minor amount of a primary rust inhibitor, and a minor amount of an esterification product having a total acid number (TAN) that is in the range of about 10 to about 40 and being prepared by reacting in the presence of a catalyst and at a temperature in the range of about 25° C. (77° F.) to about 111° C. (232° F.) ethylene oxide/propylene oxide block copolymer with a long-chain monocarboxylic acid having an alkyl radical with sufficient carbon atoms to provide solubility of said product in said composition.

The method of the present invention is a method for operating an internal combustion engine to inhibit rust formation, which method comprises lubricating said engine with a lubricating oil composition comprising a major amount of a hydrocarbon oil of lubricating viscosity, a minor amount of a dispersant, a minor amount of a primary rust inhibitor, and a minor amount of an esterification product having a total acid number (TAN) that is in the range of about 10 to about 40 and being prepared by reacting in the presence of a catalyst and at a temperature in the range of about 25° C. (77° F.) to about 111° C (232° F.) ethylene oxide/propylene oxide block copolymer with a long-chain monocarboxylic acid having an alkyl radical with sufficient carbon atoms to provide solubility of said product in said composition.

A lubricating oil composition comprises a number of components, many of which are present in very small amounts. Such components include, but are not limited to, a viscosity index improver, a dispersant, a metal dialkyldithiophosphate, a metal sulfonate or overbased metal sulfonate, a flow improver, a metal phenate or overbased metal phenate, and a detergent. The composition may contain, in addition to a major amount of a hydrocarbon oil, one or more of such components, or even all of them.

The lubricating oil composition of the present invention comprises a major amount of a hydrocarbon oil having a lubricating viscosity. Such hydrocarbon oil can be either a natural oil or a synthetic oil, or a mixture of natural oils and/or synthetic oils.

Among the natural oils are the animal oils, vegetable oils, and liquid petroleum oils. Liquid petroleum oils, such as 5W, 10W, or even 40W oils, which include naphthenic base, paraffinic base, and mixed base mineral oils, are suitable. In addition, hydrocarbon oils of lubricating viscosity that are derived from coal and shale are suitable natural oils.

Synthetic oils that are suitable lubricating oils include polymerized and interpolymerized olefins, alkylbenzenes, alkylated diphenyl ethers and alkylated diphenyl sulfides and derivatives, analogs, and homologs thereof. Moreover, alkylene oxide polymers and interpolymers and derivatives thereof where the terminal hydroxyl groups have been modified by esterification or etherification, e.g., those prepared through polymerization of ethylene oxide or propylene oxide, the alkyl and aryl ethers of these polyoxyalkylene polymers, or mono- and polycarboxylic esters thereof, such as acetic acid esters or mixed $C_3$–$C_8$ fatty acid esters, are suitable synthetic lubricating oils. Esters of dicarboxylic acids, such as phthalic acid, succinic acid, maleic acid, alkyl succinic acids, or alkenyl succinic acids, and esters made from $C_5$ to $C_{12}$ monocarboxylic acids and polyols and polyol ethers, e.g., neopentyl glycol and tripentaerythritol, are also suitable synthetic lubricating oils.

In general, any oil of lubricating viscosity can be used as the major component of the lubricating oil compositions of the present invention. For example, oils having viscosities in the range of about 15 Saybolt Universal Seconds (SUS) at 100° C. (212° F.) to about 250 SUS at 100° C. (212° F.) are suitable. Oils which have viscosities in the range of about 15 SUS at 100° C. (212° F.) to about 100 SUS at 100° C. (212° F.) are preferred.

The lubricating oil composition of the present invention is intended for use as a crankcase motor oil in both spark-ignited and compression-ignited internal combustion engines, which include gasoline engines and diesel engines. As a result, embodiments of this lubricating oil composition will contain one or more conventionally used additives in addition to those required. Such additives will be present in amounts that will support their normal functions. A dispersant and a rust inhibitor are required. A viscosity index improver, a pour point depressant, and a detergent are other additives that can be used.

Detergent additives are chemical compounds which reduce or prevent the formation of deposits in engines that are operated at high temperatures. Such chemical compounds are selected from metal sulfonates, phosphonates and/or thiophosphates, phenates, and alkyl-substituted salicylates. While any of the above detergent additives may be used in the lubricating oil composition of the present invention, overbased alkaline earth metal sulfonates, particularly overbased magnesium sulfonate, and overbased alkaline earth metal phenates are preferred. Originally, normal salts of an acid were used as detergents. A normal salt of an acid is one which contains the stoichiometric amount of metal that is required to neutralize the acidic group or groups that are present. On the other hand, a basic salt is one in which there is more metal than is needed to satisfy a neutralization reaction. For example, in the case of the petroleum sulfonic acids, normal salts of petroleum sulfonic acids were used as additives in lubricating oil compositions. During World War II, normal metal sulfonates that were derived from mahogany or petroleum sulfonic acids were employed as detergent additives in crankcase oils for internal combustion engines. Typically, calcium or barium was employed as a metal in such sulfonates. Subsequently, sulfonate products which contained as much as twice as much metal as the corresponding metal sulfonate were found to have improved detergent power and ability to neutralize acidic contaminants and, hence, were used in the place of the normal sulfonates. More recently, fully oil-soluble sulfonates containing from three up to twenty or more times as much metal as a corresponding metal sulfonate have been developed. Such highly basic sulfonates have been identified also as "overbased", "superbased", and "hyperbased".

Over the years, numerous methods for preparing overbased sulfonates have been disclosed. In general, such overbased sulfonates have been prepared by mixing a promoter and a solvent with a normal sulfonate and an excessive amount of a metallic base of either an alkali metal or an alkaline earth metal, heating the resulting mixture, carbonating the resulting reaction mass with sufficient carbon dioxide to increase the amount of metal base colloidally dispersed as metal carbonate in the resulting product, and then filtering the resulting material. Overbased sulfonates and their preparation are discussed in U.S. Pat. Nos. 3,488,284; 3,779,920; 4,394,276; 4,394,277; and 4,563,293.

Another group of detergents that are preferred for use in the lubricating oil composition of the present invention are overbased alkaline earth metal phenates. Such overbased phenates not only can provide a detergent function, but also can provide corrosion inhibition and antioxidant properties.

Overbased phenates may be prepared by reacting an alkyl phenol with an excess of an alkali metal or alkaline earth metal substance in the presence of a lower molecular weight dihydric alcohol, e.g., and alkane vicinal diol having up to six carbon atoms. A sulfurized phenate can be prepared by sulfurizing a phenolic compound to produce a sulfide, which is reacted subsequently with an alkaline earth metal compound. Alternatively, a sulfurized product can be obtained by heating elemental sulfur, an alkaline earth metal-containing compound, a phenolic compound, and a dihydric alcohol to provide simultaneous metal addition and sulfurization. The effectiveness of basic metal phenates as lubricating oil detergents is enhanced by a carbonation treatment, typically exemplified by a treatment of the basic salt with carbon dioxide. Carbonation is conducted in order to incorporate excess metal as colloidal metal carbonate in the additive. The preparation of overbased phenates and overbased sulfurized phenates is well-known in the art. Examples are provided in U.S. Pat. Nos. 3,779,920; 4,394,276; 4,394,277; and 4,563,293.

Dispersant additives are chemical compounds which have the ability to disperse sludge formed in gasoline engines that are operated primarily at relatively low cooling jacket temperatures. Sludge is a mixture of fuel combustion products, carbon, unburned fuel, water, and, in the case where lead-containing fuel is used, lead anti-knock residues. Sludge is formed in engines that are operated at relatively low temperatures, which exist in short-trip, stop-and-go driving conditions associated with the operation of most passenger automobiles, taxis, and door-to-door delivery vehicles. The presence of sludge in a lubricating oil composition is undesirable, since it affects deleteriously engine performance. Dispersants, as well as detergents, may be added to the lubricating oil composition to maintain cleanliness in the engine. Typical dispersants are copolymers which are prepared by the copolymerization of long-chain alkyl acrylates or methacrylates with monomers having various polar functions, N-substituted, long-chain alkenyl succinimides, and high-molecular weight amides and polyamides.

Any of the dispersants that are known in the art are suitable for use in the lubricating oil composition of the present invention. For example, reaction products of a monocarboxylic acid, a dicarboxylic acid, a polycarboxylic acid, or derivatives thereof, with nitrogen-containing compounds, such as amines, are suitable. These reaction products, identified as carboxylic polyamine dispersants, are discussed in U.S. Pat. Nos. 3,163,603; 3,184,474; 3,215,707; 3,219,666; 3,271,310; and 3,272,746. Dispersants, identified as alkyl polyamine dispersants and comprising reaction products of aliphatic alicyclic halides containing at least about 40 carbon atoms with amines, preferably polyalkylene polyamines, are discussed in U.S. Pat. Nos. 3,275,554; 3,438,757; 3,454,555; and 3,565,804. Dispersants, identified as Mannich polyamine dispersants and comprising the reaction products of an alkylphenol or an oxidized olefinic polymer, wherein the alkyl group is oil soluble, with aliphatic aldehydes containing 1 to 7 carbon atoms and amines, particularly alkylene polyamines, are discussed in U.S. Pat. Nos. 2,459,112; 3,036,003; 3,355,270; 3,461,172; 3,442,808; 3,459,661; 3,544,470; 3,697,574; 3,591,598; 3,649,229; 3,726,882; and 4,011,380. Dispersants identified as polymeric polyamine dispersants and comprising polymers containing an oil-solubilizing group, e.g., a pendant alkyl group having at least about 8 carbon atoms, and a polar group, e.g., interpolymers of decyl methacrylate, vinyl decyl ether, or a relatively high molecular weight olefin with amino alkyl acrylates, amino alkyl acrylamides or poly-(oxyalkalene)-substituted alkyl acrylates, as well as copolymers of styrene alkyl maleates, and maleic acid amides or imides, respectively, are discussed in U.S. Pat. Nos. 3,329,658; 3,449,250; 3,519,565; 3,666,730; 3,687,849; and 3,702,300. Dispersants comprising products obtained by post-treating dicarboxylic polyamine, alkylpolyamine, Mannich or polymeric polyamine dispersants with such reagents as urea, thiourea, carbon disulfide, aldehydes, ketones, carboxylic acids, hydrocarbon-substituted succinic anhydrides, nitriles, epoxides, boron compounds, and phosphorus compounds are described in U.S. Pat. Nos. 3,036,003; 3,087,936; 3,200,107; 3,282,955; 3,366,569; 3,502,677; 3,639,242; 3,649,229; 3,702,757; 3,704,308; and 3,708,522.

A corrosion inhibitor is a material which protects corrosion-susceptible, non-ferrous metal engine components, such as bearings, from attack by acidic contaminants in the lubricating oil composition. Examples of corrosion inhibitors are metal dithiophosphates, particularly zinc dialkyldithiophosphates, and metal dithiocarbonates, particularly zinc dithiocarbonates.

Rust inhibitors are materials which protect ferrous metal surfaces in the engine against rust. Examples of rust inhibitors are (1) overbased magnesium sulfonates prepared from polyalkenes, such as polybutene and polypropene, and (2) ethoxylated alkylphenols.

The various components introduced into a base oil to produce a lubricating oil composition can be added as a dispersant-inhibitor (DI) package. A typical DI package contains a viscosity index improver, a dispersant, zinc dialkyldithiophosphate, a sulfurized corrosion inhibitor, an overbased magnesium sulfonate rust inhibitor, a flow improver, an overbased calcium sulfonate detergent, an overbased calcium phenate, and a small amount of base oil.

Suitable sulfurized inhibitors are represented by sulfurized overbased alkaline earth metal phenates and sulfurized polyolefins.

An essential component of the lubricating oil compositions of the present invention is the supplemental rust inhibitor (SRI) which is characterized by its compatibility with other components in the lubricating oil composition of the present invention and by its ability to provide very good rust inhibition when used with a primary rust inhibitor. This SRI is prepared by reacting an ethylene oxide/propylene oxide block copolymer with a long-chain monocarboxylic acid having an alkyl radical with sufficient carbon atoms to provide solubility of the SRI in the lubricating oil composition. The reaction is carried out in the presence of a catalyst and at a temperature in the range of about 25° C. (77° F.) to about 111° C. (232° F.). The product has a total acid number (TAN) that is in the range of about 10 to about 40. The TAN of a material is the quantity of base, expressed in milligrams of potassium hydroxide, that is required to neutralize all acidic constituents present in 1 gram of that material. The TAN is obtained by ASTM Test Method D664-81.

The SRI of the present invention is prepared by esterifying an ethylene oxide/propylene oxide block copolymer with a monocarboxylic acid in the presence of a catalyst. It is contemplated that the ethylene oxide/propylene oxide block copolymer will have a molecular weight that is in the range of about 1,000 to about 5,000, preferably, about 2,000 to about 3,000, in order to provide the needed compatibility of the SRI of the present invention with the other components of the lubricating oil.

Suitable catalysts for the esterification reaction are p-toluene sulfonic acid and sulfuric acid. A preferred catalyst is p-toluene sulfonic acid.

Suitable ethylene oxide/propylene oxide block copolymers can be obtained from BASF Wyandotte, such as Pluronic® PL-61 (or DB-2061), and Pluronic® PL-81 (or DB-2081), and from Polysciences, Inc., e.g., Polysciences 16273. BASF Wyandotte describes PL-61 as a polyol ether demulsifier base and indicates that it has borderline water dispersibility. BASF Wyandotte describes the Pluronic® Polyol Series as a series of related difunctional block-polymers terminating in primary hydroxyl groups and as being nonionic. Pluronic® PL-61 is characterized as having a molecular weight of about 2,000 and Pluronic® PL-81 is characterized as having a molecular weight of about 2,700. The Pluronic® PL-61 has borderline water dispersibility while Pluronic® PL-81 is water insoluble.

A long-chain monocarboxylic acid is employed in the preparation of the SRI of the present invention. Such monocarboxylic acid must have an alkyl radical with sufficient carbon atoms to provide solubility of the SRI in the lubricating oil composition. It is contemplated that long-chain monocarboxylic acids, such as oleic acid, linoleic acid, isostearic acid, linolenic acid, and palmitic acid, are suitable for use in the preparation of the SRI of the present invention. Oleic acid is preferred.

The SRI of the present invention is prepared by reacting the monocarboxylic acid with the ethylene oxide/propylene oxide block copolymer polyol at a temperature in the range of about 25° C. (77° F.) to about 111° C. (232° F.) and in the presence of an acid catalyst. The preferred catalyst is p-toluene sulfonic acid, which is employed in an amount that is in the range of about 1 mole % to about 20 mole %, based on the moles of polymer present. An advantageous catalyst charge rate is about 5 mole %, based on the moles of polymer involved. Other catalysts that are suitable for this esterification reaction are sulfuric acid, hydrochloric acid, phosphoric acid, and acid cation exchangers. The catalyst remains in the product.

Typically, the esterification reaction is carried out in the presence of a refluxing toluene solvent over a period of time in the range of about 3 hr to about 4 hr. At the end of the reaction, the solvent is removed at a temperature of about 150° C. (302° F.) with a nitrogen stream. It is contemplated that the reaction can be conducted in the absence of the solvent.

The relative amounts of the reactants that are used are typically in the range of about 1 equivalent (equiv) of monocarboxylic acid per equiv of block copolymer to about 5 equiv of monocarboxylic acid per equiv of block copolymer. Preferably, the reactants are present in amounts that provide a ratio of reactants that is in the range of about 2 equiv of acid per equiv of block copolymer to about 3 equiv of acid per equiv of block copolymer.

When an ethylene oxide/propylene oxide block copolymer ester is made with 3 equiv of oleic acid per equiv of copolymer, the TAN will be typically about 36. This corresponds to 0.185 gm oleic acid per gm of product (18.5% unreacted oleic acid). Oleic acid is present in the product in an amount in the range of about 0 wt% to about 30 wt%, preferably, in an amount in the range of about 10 wt% to about 20 wt%.

Infrared spectroscopic evaluations of the esterification products of the present invention show the presence of ester carbonyl group absorption bands at $1740 \pm 5$ $cm^{-1}$ and the lack of hydroxyl absorption bands at $3600 \pm 200$ $cm^{-1}$.

Typically, the SRI is present in the lubricating oil composition of the present invention in an amount that is in the range of about 0.03 wt % to about 1 wt %, based on the weight of the composition. Preferably, the SRI is present in the lubricating oil composition in an amount that is in the range of about 0.05 wt % to about 0.3 wt %, based on the weight of the composition.

The following examples are presented hereinafter to help facilitate an understanding of the present invention. They are presented for the purpose of illustration and are not intended to limit the scope of the present invention.

EXAMPLE I

A series of tests was conducted to determine the compatibility of dispersant inhibitor (DI) packages with either an ethylene oxide/propylene oxide block copolymer, hereinafter identified as "Copolymer 1", or an esterified ethylene oxide/propylene oxide block copolymer, identified hereinafter as "Ester 1".

Pluronic® DB-2061, obtained from BASF Wyandotte, was used as "Copolymer 1". Ester 1 was prepared by refluxing a solution of 50 gm (0.025 mole) of Copolymer 1, 20 gm (3 equiv) of oleic acid (reagent grade), and 0.1 gm of p-toluene sulfonic acid in 100 ml of toluene (reagent grade). The refluxing was carried out for 3 hr in a round-bottomed flask, equipped with an overhead stirrer and a Dean-Stark trap. One ml of water was collected. The toluene was removed by heating the flask contents to a temperature of 150° C. (302° F.) and passing a stream of nitrogen therethrough at a rate of 1,500 cc/min.

Each of Copolymer 1 and Ester 1 was used as an SRI in each of two lubricating oil compositions. The first composition contained DI Package A, while the second composition contained DI Package B. DI Package A contained 1.7 wt% overbased calcium sulfonate and 3.2 wt% Mannich dispersant, as well as calcium sulfonate, zinc dialkyldithiophosphate, a metal-containing wear inhibitor, and a flow improver. DI Package B contained 1.1 wt% overbased magnesium sulfonate, 0.2 wt% overbased calcium sulfonate, and 3.2 wt% Mannich dispersant, as well as zinc dialkyldithiophosphate, a metal-containing wear inhibitor, and a flow improver. Each of the resulting samples, Sample Nos. 1, 2, 3, and 4, was evaluated for the compatibility of its particular SRI with its DI package, as demonstrated by the clarity of the sample after two-weeks storage at a temperature of 54° C. (130° F.).

In each case, the SRI to be tested was blended with the selected DI package additive concentrate. The sample was then stored for 2 weeks at a temperature of 54° C. (130° F.). At the end of 2 weeks, each sample was observed for its DI compatibility. A clear sample indicated compatibility of the SRI with the DI package employed. The results of these evaluations are presented hereinbelow in Table I.

TABLE I

DI Compatibilities of Ester 1 and Copolymer 1

| Sample | DI Package, wt % | | SRI, wt % | | |
|---|---|---|---|---|---|
| | DI Pkg A | DI Pkg B | Copolymer 1 | Ester 1 | Appearance |
| 1 | 97.3 | | 2.7 | | clear |
| 2 | | 96.7 | 3.3 | | hazy, sep |
| 3 | 97.3 | | | 2.7 | clear |
| 4 | | 96.7 | | 3.3 | clear |

The esterified ethylene oxide/propylene oxide block copolymer, Ester 1, was found to be compatible with either DI package. However, the original ethylene oxide/propylene oxide block copolymer was compatible with only one of the DI packages.

EXAMPLE II

A sample of the esterified ethylene oxide/propylene oxide block copolymer that was prepared in Example I, i.e., Ester 1, was evaluated in the Boating Industry Association (BIA) Rust Test. The test was conducted with a steel panel that is described in Paragraph 10 of Appendix 1 of ASTM D1748.

The steel panel was thoroughly cleaned by first removing any preservative with cold naphtha, dipping the panel in boiling naphtha, and then dipping the panel in boiling anhydrous methanol.

The clean panel at a temperature of 21.1° C. (70° F.) was immersed in the oil to be tested at a temperature of 21.1° C. (70° F.) for 10 min and subsequently drained vertically for 10 min in 21.1° C. (70° F.) still air. The panel was then immersed vertically for 8 hr in 21.1° C.±5.5° C. (70° F.±10° F.) sodium chloride solution having been prepared by dissolving 0.5 lb of chemically pure sodium chloride in 1 gal of distilled water. Rust was evaluated visually. The test was passed, since no rust appeared except in the area within 1/4 in of panel edges or within ⅛ in of any holes.

The composition that was tested, Sample 5, contained 0.2 wt% Ester 1, based on the weight of the composition. Sample 6 was the same composition excluding Ester 1. It also was evaluated in the BIA Rust Test. The results of these tests are presented in Table II hereinbelow.

TABLE II

Rust Prevention by Ester 1 Per BIA Rust Test

| Sample | Ester 1, wt % | % Rust After 24 Hours |
|---|---|---|
| 5 | 0.2 | 0 |
| 6 | 0.0 | 100 |

The esterified ethylene oxide/propylene oxide block copolymer, Ester 1, provided excellent rust performance for Sample 5.

EXAMPLE III

A sample of Ester 1, as well as a sample of a commercial SRI obtained from Amoco Petroleum Additives Company, was evaluated for its rust performance in the IID Engine Test. The commercial SRI is identified hereinafter as CSRI.

The IID Engine Test used a 1977, 350 CID (5.7 liter) Oldsmobile V-8 engine. The engine was operated at moderate speed (1500 rpm) for 30 hr, was shut down for 30 min, and then was operated for 2 hr at high speed (3600 rpm). The valve train was evaluated for the tendency of the oil to rust or corrode it. An average rust value of 10 corresponded to clean rust performance.

The results of the IID tests are presented hereinafter in Table III.

TABLE III

IID Engine Test for Ester 1

| Sample | SRI | | Average Rust |
|---|---|---|---|
| | Type | Amount, wt % | |
| 7 | CSRI | 0.2 | 7.46 |
| 8 | Ester 1 | 0.2 | 8.10 |

The SRI of the present invention, Ester 1, provided better rust performance in the IID Engine Test than did the commercial SRI, CSRI.

EXAMPLE IV

Another ethylene oxide/propylene oxide block copolymer obtained from BASF Wyandotte, Pluronic® DB-2081, identified hereinafter as Copolymer 2, was esterified as described hereinabove in Example 1. The reaction was conducted with 100 gm (0.036 mole) of Copolymer 2, 29 gm (3 equiv) of oleic acid, and 0.1 gm of p-toluene sulfonic acid. The esterified product is identified hereinafter as Ester 2.

Each of Copolymer 2 and Ester 2 was used as an SRI in each of two lubricating oil compositions. Again, DI Packages A and B were used in separate formulations. The DI compatibilities of Copolymer 2 and Ester 2 with each DI package were determined as described hereinabove in Example I. The results are presented hereinbelow in Table IV.

TABLE IV

| DI Compatibilities of Copolymer 2 and Ester 2 | | | | | |
|---|---|---|---|---|---|
| Sample | DI Package, wt % | | SRI, wt % | | Appearance |
| | DI Pkg A | DI Pkg B | Copolymer 2 | Ester 2 | |
| 9 | 97.3 | | 2.7 | | clear |
| 10 | | 96.7 | 3.3 | | gel |
| 11 | 97.3 | | | 2.7 | clear |
| 12 | | 96.7 | | 3.3 | clear |

Ester 2 was shown to be compatible with either DI package while the corresponding original copolymer, Copolymer 2, was shown to be compatible with only one of the DI packages.

EXAMPLE V

Both Cjopolymer 2 and Ester 2 were evaluated in the BIA Rust Test, as described in Example II hereinabove. The results are presented hereinbelow in Table V.

TABLE V

| Rust Prevention by Ester 2 per BIA Rust Test | | | |
|---|---|---|---|
| Sample | Ester 2, wt % | Copolymer 2, wt % | % Rust After 24 Hours |
| 13 | 0.2 | 0.0 | 10 |
| 14 | 0.0 | 0.2 | 20 |
| 15 | 0.0 | 0.0 | 100 |

A large portion of the Copolymer 2 precipitated from the test solution of Sample 14.

Rust performance of the Eser 2, Sample 13, was quite good and was better than that of Copolymer 2, Sample 14.

EXAMPLE VI

A sample of Ester 2, as well as a sample of the commercial SRI, CSRI, was evaluated for its rust performance in the IID Engine Test. The results of these tests are presented hereinbelow in Table VI.

TABLE VI

| IID Engine Test for Ester 2 | | | |
|---|---|---|---|
| | SRI | | |
| Sample | Type | Amount, wt % | Average Rust[1] |
| 16 | CSRI | 0.2 | 8.57 |
| 17 | Ester 2 | 0.2 | 8.72 |

The sample containing Ester 2 as the SRI, Sample 17, outperformed the sample containing the commercial SRI, Sample 16.

The esterified ethylene oxide/propylene oxide block copolymer products of the present invention are shown in the above examples to be compatible with conventional DI packages and to provide quality rust performance in both the BIA Rust Test and the IID Engine Test. They are completely compatible with fully formulated oils and are easily prepared, their preparation utilizing inexpensive carboxylic acids to modify more expensive polymers.

The use of these SRI's will permit a substantial decrease in the amount of primary inhibitor needed.

What is claimed is:

1. A lubricating oil composition comprising a major amount of a hydrocarbon oil of lubricating viscosity, a minor amount of a dispersant, a minor amount of a primary rust inhibitor, and from about 0.03% to about 1 wt. %, based on the weight of the oil composition, of an esterification product having a total acid number (TAN) that is in the range of about 10 to about 40 and being prepared by reacting in the presence of a catalyst and at a temperature in the range of about 25° C. (77° F.) to about 111° C. (232° F.) ethylene oxide/propylene oxide block copolymer with a long-chain monocarboxylic acid having an alkyl radical with sufficient carbon atoms to provide solubility of said product in said composition.

2. The composition of claim 1, wherein said monocarboxylic acid is oleic acid or linoleic acid.

3. The composition of claim 1, wherein said monocarboxylic acid is oleic acid and is present in an amount to provide a ratio of oleic acid to said copolymer that is in the range of about 1 to about 5 equivalents of oleic acid per equivalent of copolymer.

4. The composition of claim 3, wherein said reacting is carried out in the presence of p-toluene sulfonic acid catalyst, said p-toluene sulfonic acid being present in an amount in the range of about 1 mole % to about 20 mole % p-toluene sulfonic acid, based on the amount of copolymer.

5. The composition of claim 1, wherein said reacting is carried out in the presence of a catalyst and at a temperature in the range of about 25° C. (77° F.) to about 111° C. (232° F.).

6. The composition of claim 5, wherein said catalyst is p-toluene sulfonic acid, said p-toluene sulfonic acid being present in an amount in the range of about 1 mole % to about 20 mole % p-toluene sulfonic acid, based on the amount of copolymer.

7. The composition of claim 6, wherein said reacting is carried out in the presence of a solvent.

8. The composition of claim 1, wherein said reacting is carried out in the presence of a solvent.

9. The composition of claim 1, wherein said dispersant is a Mannich polyamine dispersant and wherein said composition further comprises (i) a minor amount of overbased metal sulfonate selected from the group consisting of overbased calcium sulfonate and overbased magnesium sulfonate and (ii) a minor amount of zinc dialkyldithiophosphate.

10. A method for operating an internal combustion engine to inhibit rust formation, which method comprises lubricating said engine with a lubricating oil composition comprising a major amount of a hydrocarbon oil of lubricating viscosity, a minor amount of a dispersant, a minor amount of a primary rust inhibitor, and from about 0.03% to about 1 wt. % based on the weight of the oil composition of a compatible lubricating oil supplemental rust inhibitor consisting essentially of a reaction product having a total acid number (TAN) that is in the range of about 10 to about 40 of a nonionic polyol ether ethylene oxide/propylene oxide block copolymer of a molecular weight of from about 2000 to about 3000, which is borderline water dispersible to water insoluble, with a long-chain monocarboxylic acid having an alkyl radical with sufficient carbon atoms to provide solubility of said product in said composition.

11. The method of claim 10, wherein said monocarboxylic acid is oleic acid or linoleic acid.

12. The method of claim 10, wherein said monocarboxylic acid is oleic acid and is present in an amount to provide a ratio of oleic acid to said copolymer that is in the range of about 1 to about 5 equivalents of oleic acid per equivalent of copolymer.

13. The method of claim 12, wherein said reacting is carried out in the presence of p-toluene sulfonic acid catalyst, said p-toluene sulfonic acid being present in an amount in the range of about 1 mole % to about 20 mole % p-toluene sulfonic acid, based on the amount of said copolymer.

14. The method of claim 10, wherein said reacting is carried out in the presence of a catalyst and at a temperature in the range of about 25° C. (77° F.) to about 111° C. (232° F.)

15. The method of claim 14, wherein said catalyst is p-toluene sulfonic acid, said p-toluene sulfonic acid being present in an amount in the range of about 1 mole % to about 20 mole % p-toluene sulfonic acid, based on the amount of copolymer.

16. The method of claim 15, wherein said reacting is carried out in the presence of a solvent.

17. The method of claim 10, wherein said reacting is carried out in the presence of a solvent.

18. The method of claim 10, wherein said dispersant is a Mannich polyamine dispersant and wherein said composition further comprises (i) a minor amount of overbased metal sulfonate selected from the group consisting of overbased calcium sulfonate and overbased magnesium sulfonate and (ii) a minor amount of zinc dialkyldithiophosphate.

* * * * *